US012520916B2

(12) United States Patent
Tomasik

(10) Patent No.: US 12,520,916 B2
(45) Date of Patent: Jan. 13, 2026

(54) SHALLOW DEPTH CUT DIAMONDS

(71) Applicant: Leszek Tomasik, Mount Prospect, IL (US)

(72) Inventor: Leszek Tomasik, Mount Prospect, IL (US)

(73) Assignee: Leszek Tomasik, Mount Prospect, IL (US)

( * ) Notice: Subject to any disclaimer, the term of this patent is extended or adjusted under 35 U.S.C. 154(b) by 253 days.

(21) Appl. No.: 17/397,286

(22) Filed: Aug. 9, 2021

(65) Prior Publication Data

US 2021/0361039 A1 Nov. 25, 2021

Related U.S. Application Data

(63) Continuation of application No. 15/283,194, filed on Sep. 30, 2016, now abandoned.

(51) Int. Cl.
*A44C 17/00* (2006.01)

(52) U.S. Cl.
CPC ..... *A44C 17/00* (2013.01)

(58) Field of Classification Search
CPC ..... A44C 17/001
See application file for complete search history.

(56) References Cited

U.S. PATENT DOCUMENTS 4,083,352 A * 4/1978 Andrychuk ..... B28D 5/00 451/41
5,722,261 A * 3/1998 Lehrer ..... B24B 9/16 63/32
6,433,483 B1 * 8/2002 Michael ..... A44C 15/0015 315/307
6,705,114 B2 3/2004 Steiner ..... 63/32
7,249,471 B2 * 7/2007 Kawabuchi ..... A44C 17/001 63/32
9,398,791 B1 * 7/2016 Slowinski ..... A44C 17/00
2005/0166635 A1 * 8/2005 Kawabuchi ..... A44C 17/001 63/32
2007/0006616 A1 * 1/2007 Riemer ..... A44C 17/001 63/32

(Continued)

FOREIGN PATENT DOCUMENTS

EP 2179672 A1 * 4/2010 ..... A44C 17/001
WO WO-2009078884 A1 * 6/2009 ..... A44C 17/001

OTHER PUBLICATIONS

Gemological Institute of America, "Diamond Cut: Anatomy of a round brilliant", Jan. 14, 2016 (Year: 2016).*

(Continued)

*Primary Examiner* — Emily M Morgan
(74) *Attorney, Agent, or Firm* — Stein IP, LLC

(57) ABSTRACT

The invention is directed to shallow pavilion, cut diamonds having excellent optical characteristics. The pavilion surface includes a plurality of substantially planar main pavilion facets, each of which extend from the girdle to a pointed culet defining the bottom most portion of the cut diamond. The crown angle is in the range of between about 29 degrees to about 36 degrees, and the pavilion angle is in the range of between about 15 degrees and about 34.5 degrees. The shallow pavilion, cut diamonds of the invention may be either round shaped cut diamonds or fancy shaped cut diamonds.

24 Claims, 14 Drawing Sheets

(56) References Cited

U.S. PATENT DOCUMENTS

| | | | | |
|---|---|---|---|---|
| 2008/0271484 | A1* | 11/2008 | Rydlewicz | A44C 17/007 63/32 |
| 2008/0271488 | A1* | 11/2008 | Rydlewicz | A44C 17/001 63/32 |
| 2009/0260396 | A1* | 10/2009 | Broukman | A44C 17/001 83/13 |
| 2011/0000259 | A1* | 1/2011 | Strnad, III | A44C 17/001 63/32 |
| 2011/0041554 | A1* | 2/2011 | Zaveri | A44C 17/002 63/28 |
| 2013/0055763 | A1* | 3/2013 | Ritchie | A44C 17/001 451/41 |
| 2013/0213090 | A1* | 8/2013 | Ritchie | A44C 17/001 63/32 |
| 2014/0067331 | A1* | 3/2014 | Benjano | A44C 27/00 703/1 |
| 2016/0213104 | A1* | 7/2016 | Slowinski | A44C 17/00 |
| 2017/0196318 | A1* | 7/2017 | Wagner | A44C 17/001 |
| 2019/0261747 | A1* | 8/2019 | Reiss | A44C 17/001 |

OTHER PUBLICATIONS

Google image search results, "diamond hearts and arrows" (Year: 2020).

* cited by examiner

SHALLOW DEPTH CUT DIAMONDS

INCORPORATION BY REFERENCE

This is a continuation of U.S. application Ser. No. 15/283,194 filed on Sep. 30, 2016, the entire contents of which are incorporated herein by reference.

BACKGROUND OF THE INVENTION

Field of the Invention

The invention is directed to finished cut diamonds that have both excellent optical characteristics and exceptionally high yield for the finished stones. More specifically, the present invention provides both round and fancy shallow pavilion cut diamonds with exceptional optical characteristics.

Description of the Prior Art

In the United States market, the round, brilliant cut has been the round diamond market standard since it was developed by Marcel F. Tolkowsky in 1919. The round, brilliant cut and most other popular round cut diamonds include a relatively tall crown height, steep pavilion angle, and high total depth percentage. As a result, the girdle diameter of these stones is relatively small in comparison to their pavilion depth and the total depth of the stone. While prior art round, brilliant cut diamonds have excellent optical characteristics, their tall crown height requires a relatively high stone weight for a cut diamond of a given girdle diameter. For some rough diamond stones, this tall crown height can result in a higher than optimal loss of weight during the cutting and polishing process when converting the rough diamonds to finished stones.

Some rough diamonds, having a depth of less than about 3 mm (known in the trade as "flat stones"), are too shallow for cost efficient cutting into round, brilliant cut diamonds. The strong market preference for deep pavilion round, brilliant cut finished diamonds has rendered such flat stones (low overall depth) nearly unmarketable for use in creating high optical quality round, brilliant cut finished diamonds. One of the reasons round, brilliant cut diamonds utilize steep pavilion angles was the belief that deep pavilions were necessary to avoid the optical characteristic known in the trade as the "fish eye effect." This optical effect occurs when light loss from within one or more of the diamond's internal surfaces are sufficient that the table, when viewed from above, includes one or more areas that are substantially darker than the rest of the diamond. Such darkened "fish eye" areas are considered to be highly undesirable in a cut, finished diamond. traditionally had relatively steep pavilion angles in order to avoid inferior optical characteristics, such as the "fish eye" effect, in the finished fancy diamond. Similar to the case with the prior art round brilliant cut diamonds, the steep pavilion angles and relatively tall crown heights of the prior art fancy cut diamonds resulted in higher than optimal loss of weight (low cut weight yield) during the cutting and polishing processes.

Surprisingly, the applicant has found that cut diamonds with relatively shallow pavilion angle cuts combined with the other parameters set forth below have optical characteristics that are at least equivalent to, and often superior to, the prior art standard fancy cuts and round, brilliant cut diamonds. Moreover, due to their shallow pavilion depth, the cutting and polishing weight loss is significantly reduced for many rough stones. Further, the higher proportion of girdle diameter (round cut) or surface area (fancy cut) to stone weight provides the visual impression to consumers that the stone is significantly larger than its actual carat weight. Moreover, the applicant has discovered that round, cut diamonds with excellent optical characteristics may be cost efficiently cut from "flat stones," which can further reduce the cost of the round, shallow pavilion cut stones of the invention relative to the round, brilliant cut diamonds of the prior art.

OBJECTS OF THE INVENTION

It is an object of the invention to provide a shallow pavilion angle round, cut diamond that has good sparkle characteristics.

It is an object of the invention to provide a shallow pavilion angle fancy, cut diamond that has good sparkle characteristics.

Another object of the invention to provide a shallow pavilion cut diamond with enhanced light reflection amplification.

It is another object of the invention to provide a cut diamond with good optical characteristics that appears, when viewed from above, to be larger/heavier than its actual size/weight of the cut stone.

It is a still further object of the invention to provide round, cut diamonds that have significantly higher cut weight yield relative to the prior art round, brilliant cut diamonds.

It is another object of the invention to provide high optical quality round cut, diamonds from so called rough "flat stone" diamonds.

SUMMARY OF THE INVENTION

In a first preferred embodiment, the invention includes a cut diamond having a round shape. The round cut diamond including a table having a table plane and a substantially annular girdle. The round cut diamond has a shape and configuration that results in a specific total depth percentage, a specific crown height percentage, a specific girdle height percentage and a specific table percentage. A crown surface is located between the table and the substantially annular girdle and extends in a crown angle to the table plane. A pointed culet defines the bottom most portion of the round cut diamond. A pavilion surface extends at a pavilion angle relative to the table. The crown angle is in the range of between about 29 degrees to about 36 degrees, and the pavilion angle is in the range of between about 25 degrees and about 36 degrees.

The invention further includes fancy cut diamonds with a table having a table plane and a girdle having a non-circular circumference. The fancy cut diamonds have a shape and configuration that results in a specific total depth percentage, a specific crown height percentage, a specific girdle height percentage and a specific table percentage. A crown surface is located between the table and the girdle and extends in a crown angle to the table plane. A pavilion surface extends at a pavilion angle relative to the table. The pavilion surface includes a plurality of substantially planar main pavilion facets each of which extend from the girdle having a non-circular circumference to a pointed culet defining the bottom most portion of the cut diamond. The crown angle is in the range of between about 29 degrees to about 36 degrees and the pavilion angle is in the range of between about 15 degrees and about 34.5 degrees. For the purposes of this application, the phrase "fancy cut diamond" includes all cut diamond shapes that are other than substantially round (when viewed from above), shaped diamonds.

In another aspect, the present invention is further directed to cut diamonds having a table with a table plane and a girdle. The cut diamonds have a shape and configuration that results in a specific total depth percentage, a specific crown height percentage, a specific girdle height percentage and a specific table percentage. A crown surface is located between the table and the girdle and extends in a crown angle to the table plane. A pavilion surface extends at a pavilion angle relative to the table. The pavilion surface includes a plurality of substantially planar main pavilion facets, each of which extend from the girdle to a pointed culet defining the bottom most portion of the cut diamond. The crown angle is in the range of between about 29 degrees to about 36 degrees, and the pavilion angle is in the range of between about 15 degrees and about 34.5 degrees. The cut diamonds in accordance with this aspect of the invention may be either round shaped cut diamonds or fancy shaped cut diamonds.

DESCRIPTION OF THE DRAWINGS

The organization and manner of the structure and function of the invention, together with the further objects and advantages thereof, may be understood by reference to the following description taken in connection with the accompanying drawings, and in which.

DETAILED DESCRIPTION

Round Cut Shallow Pavilion Stones

Figure 1:
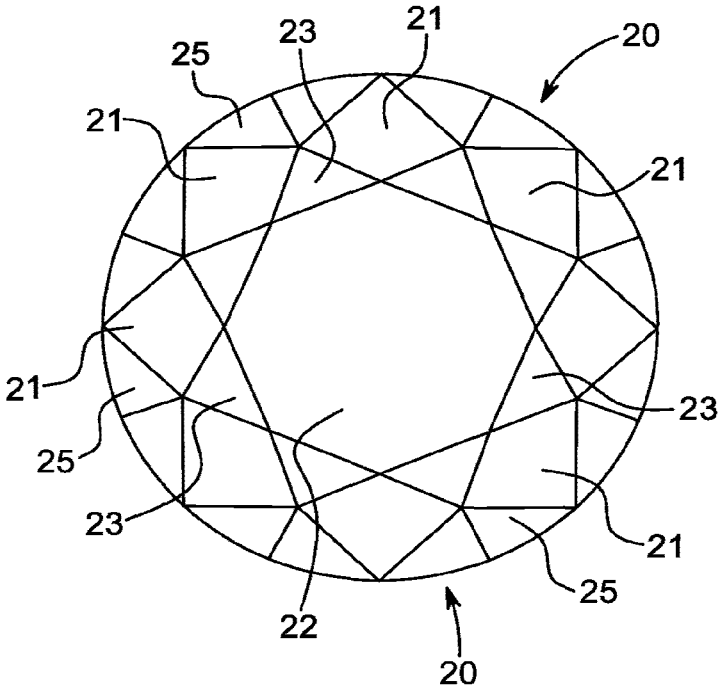
FIG. 1 is a top plan view of a round, shallow pavilion diamond in accordance with a first embodiment of the invention.
Figure 2:
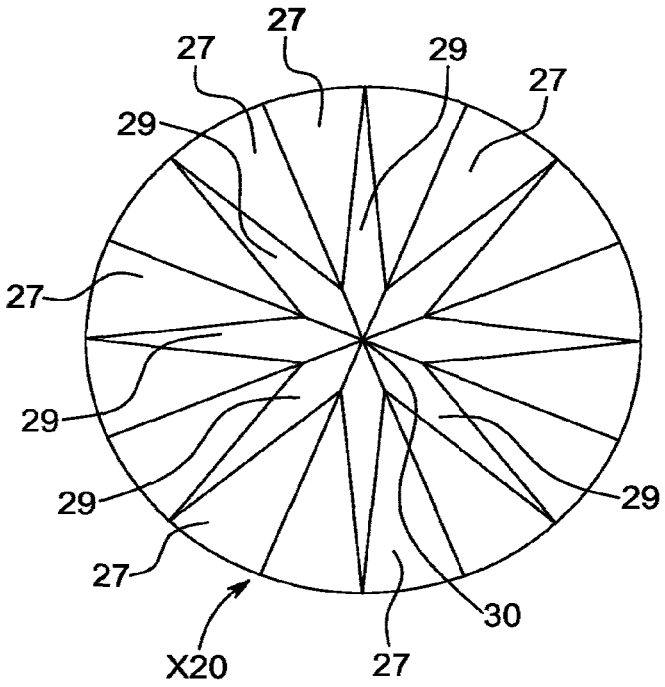
FIG. 2 is a bottom plan view of a round, shallow pavilion diamond of the invention in accordance with the embodiment of FIG. 1.
Figure 3:
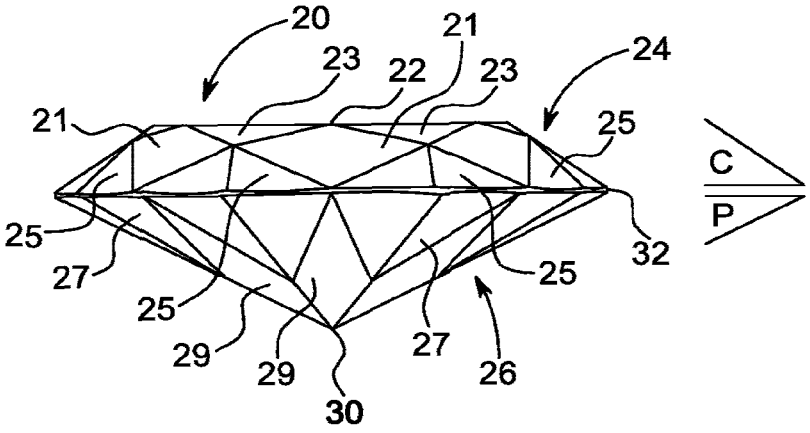
FIG. 3 is a side plan view of a round, shallow pavilion diamond of the invention in accordance with the embodiment of FIG. 1.

In accordance with a first embodiment of the invention, FIGS. 1-3 show a shallow pavilion, round cut diamond 20 having a table 22, a crown 24 extending downwardly from the table 22, a girdle 32 below the crown 24, and a pavilion 26 extending downwardly from the girdle 32. The surface of the pavilion 26 narrows in width to a pointed culet 30. FIG. 3 shows that the pavilion 26 extending at a distinct pavilion angle (<P) relative to the plane of the table (or to a line parallel to the table passing through the girdle) of the diamond stone. Similarly, the crown angle (<C) is also indicated on FIG. 3. The crown 24 and pavilion 26 portions of the round, shallow pavilion diamond 20 are separated by a narrow, substantially annular girdle portion 32. The girdle 32 is preferably either a polished single annular surface or can be multi-faceted with the multiple small facets approximating an annular surface (not shown).

More specifically, as can be seen in FIGS. 1-3, the crown 24 of the round cut diamond 20 of the invention is comprised of a total of thirty-three facets, including a single table facet 22, eight bezel facets 21, eight star facets 23, and sixteen upper girdle facets 25. The pavilion 26 comprises a total of twenty-five facets including sixteen lower girdle facets 27, eight main pavilion facets 29, and a single pointed culet 30 as shown in FIG. 3. The crown angle is measured between the surface of each of the bezel facets 21 and the plane of the table 22 (average of each measured angle for the bezel facets). The pavilion angle is measured between the plane of the table 22 and main pavilion facets 29. The pavilion 26 narrows to a pointed culet 30, that is a preferably "true point," that is, a very sharp point as shown in FIG. 3. However, the point culet 30 may be a less sharply pointed culet (not shown), which would have either a slightly larger flattened surface area than a "true point" or a slightly rounded or beveled surface defining a portion of such a culet.

In marked departure from the prior art round, brilliant cut diamonds, the present inventor has discovered that at least equivalent reflection pattern can be obtained by providing a round, shallow pavilion diamond with a very shallow pavilion, namely by forming the pavilion angles in the range of twenty five to thirty six degrees, preferably thirty to thirty two degrees, as opposed to the conventional pavilion angles which are in the range of 40 to 43 degrees. Put another way, when matched for diamond diameter and viewed from above, the round, shallow pavilion diamonds of the invention provide a stone with the same top down view and at least equivalent optical characteristics to the prior art round, brilliant cut diamonds of significantly higher carat weight. The round, shallow pavilion diamonds have a carat weight that is between 10% and 20% (typically 16%-18%) less than a matched diameter prior art, round brilliant cut diamonds. Furthermore, the shallow pavilion diamonds of the present invention can realize unexpected brilliance and light amplification characteristics with total depth percentage in a range from about twenty five percent to about fifty percent. This contrast with the total depth percentage range of between 55 to 64 percent for prior art round, brilliant cut diamonds. The maximum and minimum crown angles for the shallow pavilion, round diamonds of the invention are between about thirty two degrees and thirty six degrees with the preferred crown angles ranging from thirty three to thirty five degrees.

Table 1 below provides the relevant parameters for the round, shallow pavilion diamonds of the invention, indicating in each instance a minimum value, a maximum value and a preferred range.

TABLE 1

ANGLE AND PERCENTAGE PARAMETERS FOR ROUND CUT DIAMONDS

| PARAMETER | MINIMUM | PERFERRED RANGE | MAXIMUM |
|---|---|---|---|
| Crown Angle° | 29 | 33-35 | 36 |
| Crown Height % | 7 | 9-12 | 15 |
| Girdle Height % | 1 | 1.5-5 | 7 |
| Pavilion Angle° | 25 | 30-33 | 36 |
| Table % | 55 | 66.5-85 | 85 |
| Total Depth % | 25 | 35-47 | 50 |

Figure 5:
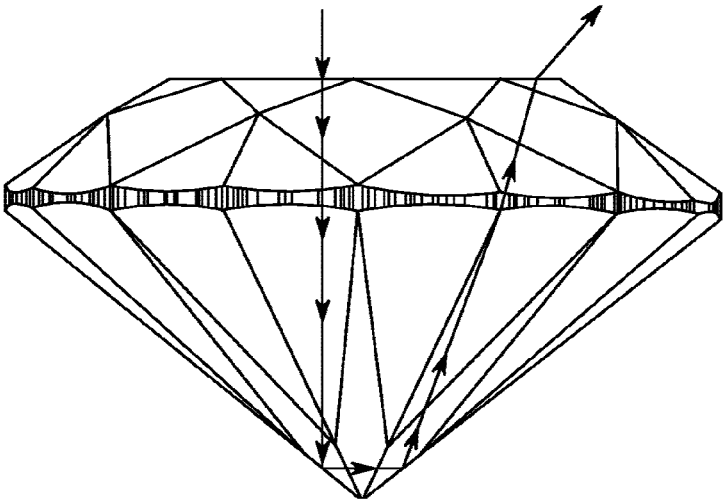
FIG. 5 PRIOR ART
FIG. 5 is a side plan view of a prior art round, brilliant cut diamond illustrating its measured light reflecting and refracting properties.
Figure 6:
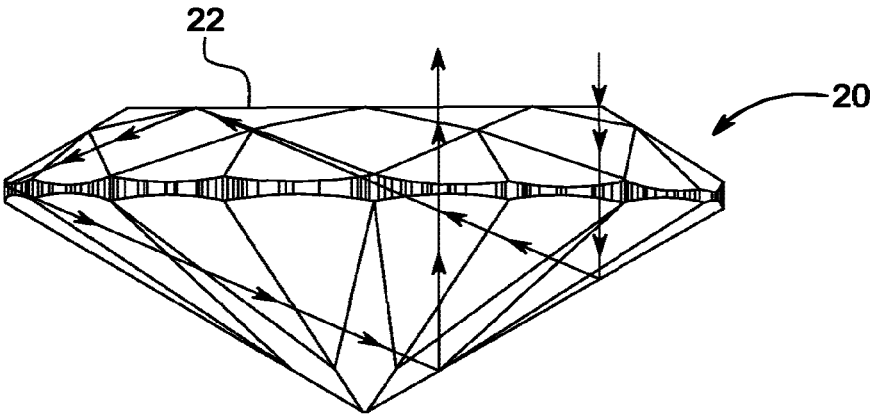
FIG. 6 is a side plan view of a round, shallow pavilion diamond of the invention illustrating its measured light reflecting and refracting properties.

FIGS. 5 and 6 illustrate the measured light reflection patterns from a shallow pavilion, round cut diamond of the first embodiment of the invention (FIG. 6) and from a conventional prior art, round brilliant cut diamond (FIG. 5). In the round, brilliant cut diamond of the prior art shown in FIG. 5, a ray of light that strikes the table perpendicularly hits the pavilion at one side, is then reflected to the opposed pavilion side and eventually reflected back out through the table with only a small portion of the light traversing the volume between the other internal surfaces of the diamond. As a result, the total light transmitted back from the table for the OGI Systems Ltd. CFire™ optical performance test is 68% as can be seen in FIG. 5.

In contrast to the prior art, the light pattern for round, shallow pavilion cut diamond 20 of the invention, follows a path whereby light rays pass through to one of the twenty-four facets of the pavilion, (1) the light rays are then reflected from the one of the twenty-four facets of the pavilion to the table facet, (2) the light rays are then reflected from the table facet to the girdle, (3) the light rays are then reflected from the girdle to one of the twenty-four facets of the pavilion, and (4) the light rays are then reflected from the one of the twenty-four facets of the pavilion out to the table. This light pattern, with light rays being repeatedly reflected and refracted between many diamond surfaces creates an unexpectedly brilliant light display for a shallow pavilion, round cut diamond. As a result of the repeated reflection and refraction, the light transmitted from the table 22 of the shallow pavilion, round diamond 20 during the OGI Systems Ltd. CFire™ optical performance test is an impressive 69% as illustrated in FIG. 6. This is slightly better than for the round, brilliant cut diamond of FIG. 5 even though when matched for diameter conventional brilliant cut, diamonds weigh between 10-20% more than the round, shallow pavilion diamond of the invention. The crown angle, crown height, girdle height, pavilion angle, table percentage and total depth for the shallow pavilion stone 20 all fall within the ranges set forth in Table 1.

Figure 4:
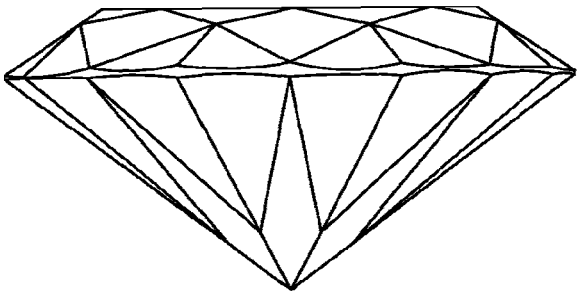
FIG. 4 PRIOR ART
FIG. 4 is a side plan view of a prior art round, brilliant cut diamond.

The crown angle for the prior art round, brilliant cut diamond shown in FIG. 4 is about thirty five degrees and the pavilion angle is about forty one degrees. The total depth percentage for the prior art diamond of FIG. 4 is about 60% and is calculated as the ratio of the height divided by the width (diameter) of the stone. The table percentage for the prior art diamond of FIG. 4 is about 53% and is calculated relative to the diameter of the stone. The corresponding values for a round, shallow pavilion cut diamonds of the present invention are set forth in the Table 1 above. As can be discerned from a comparison of the side view shown in FIG. 3 and FIG. 4, the shallow pavilion, round diamond 20 of the invention has a significantly more shallow total depth, which results from the shallow pavilion angles of the diamond of the present invention. As a result of utilizing that shallow pavilion angle and other parameters set forth in Table 1, the applicant has found that final cut and polished stones of the invention routinely provide a yield of between fifty to fifty-five percent relative to the rough diamonds from which they are cut. In many cases, the so called rough "flat stones" may be utilized to create the shallow pavilion, round cut diamonds of the invention, thereby further reducing the cost of an excellent optical quality round diamond of a given diameter. In contrast, the prior art round, brilliant cut diamond (e.g., as shown in FIG. 4) have a typical finished cut/polished stone to rough stone yields in the range from about thirty-five percent to about forty percent and usually required more expensive deep (cubic) raw stones.

Pointed Culet, Fancy Cut Shallow Pavilion Stones

In accordance with another aspect of the invention, a variety of shallow pavilion, fancy cut diamonds are provided four embodiments of which are illustrated in FIGS. 7-20. The four illustrated embodiments of the shallow pavilion, fancy cut diamonds include cushion shaped, cut diamonds 120, 120B (FIGS. 7-9B); heart shaped, cut diamonds 220, 220A (FIGS. 10-12); pear shaped, cut diamond 320 (FIGS. 13-16); and oval cut diamond 420 (FIGS. 17-20), respectively. Each of the fancy cut diamonds 120, 220, 320 and 420 have a pointed culet 130, 130B, 230, 230A, 330, and 430, respectively. While the illustrations herein shows the four most common fancy cut diamond shapes, the shallow pavilion, pointed culet, fancy cut diamonds of the invention may also be asher cut, calf cut, emerald shaped, half-moon shaped, marquise, princess cut, radiant cut, straight baguette, and trillion shaped. Table 2 below provides the relevant parameters for the shallow pavilion, fancy cut diamonds of the invention, indicating in each instance a minimum value, a maximum value and a preferred range.

TABLE 2

ANGLE AND PERCENTAGE PARAMETERS FOR FANCY CUT DIAMONDS

| PARAMETER | MINIMUM | PERFERRED RANGE | MAXIMUM |
|---|---|---|---|
| Crown Angle° | 29 | 30-35 | 36 |
| Crown Height % | 7 | 9-12 | 15 |
| Girdle Height % | 1 | 1.5-5 | 7 |
| Pavilion Angle° | 15 | 22-33 | 34.5 |
| Table % | 50 | 60-85 | 90 |
| Total Depth % | 25 | 33-43 | 55 |

Turning to the cushion shaped, shallow pavilion diamond 120 of the invention shown in FIG. 7-9, the diamond 120 has a table 122, a crown 124 extending downwardly from the table 122, a girdle 132 located below the crown 124, a pavilion 126 extending downwardly from the girdle 132, the pavilion 126 surface narrowing in width to a pointed culet 130. FIG. 9 shows that the pavilion 126 extends at a distinct pavilion angle, within the range set forth in Table 2 relative to the plane of the table (or to a line parallel to the table passing through the girdle) of the diamond. Similarly, the crown angle is also within the range set forth in Table 2. The crown 124 and pavilion 126 portions of the cushion shaped, shallow pavilion diamond 120 are separated by a narrow girdle portion 132. The girdle 132 shown in FIG. 9 is multi-faceted with tiny facets approximating rounded cushion shape, but girdle may also be a smooth polished cushion shape (not shown).

Figure 7:
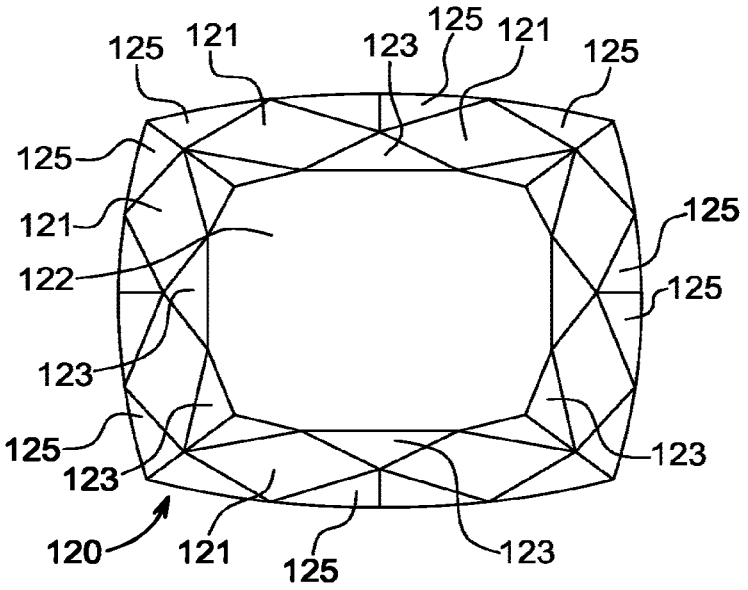
FIG. 7 is a top plan view of a first cushion shaped, shallow pavilion diamond in accordance with a second embodiment of the invention.
Figure 8:
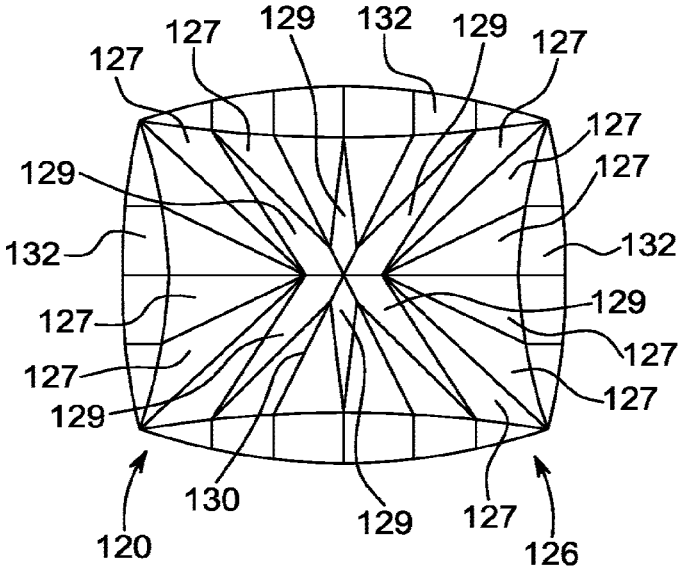
FIG. 8 is a bottom plan view of the cushion shaped, shallow pavilion diamond of the invention in accordance with the embodiment of FIG. 7.
Figure 9:
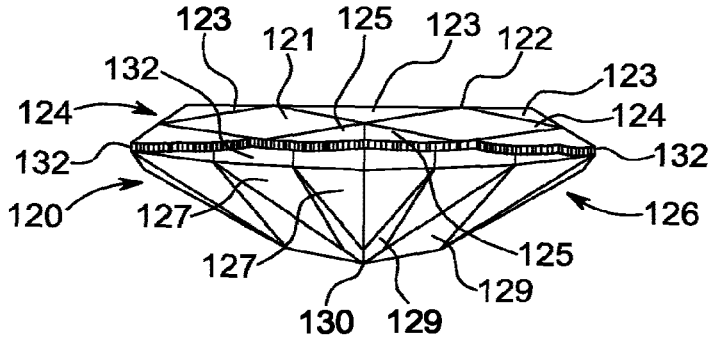
FIG. 9 is a side plan view of the short side of the cushion shaped, shallow pavilion diamond of the invention in accordance with the embodiment of FIG. 7.

More specifically, as can be seen in FIGS. 7-9, the shallow pavilion, cushion shaped diamond 120 of the invention is comprised of a total of 64 facets. The crown 124 has 37 facets including a single table facet 122, eight bezel facets 121, twelve star facets 123, and sixteen upper girdle facets 125. The pavilion 126 comprises a total of twenty seven facets including twenty lower girdle facets 127, six main pavilion facets 129, and a single pointed culet 130 as best seen in FIG. 8. The crown angle is measured between the surface of each of the bezel facets 121 and the plane of the table 122 (average of each measured angle for the bezel facets). The pavilion angle is measured between the plane of the table 122 and main pavilion facets 129. The pointed culet 130 may be a less than razor sharp such as shown with shallow angle pointed culet 130 shown in FIG. 9. Alternately, the pavilion 126 may narrow to a sharper pointed culet 130 that is a "true point," that is, a very sharp point (not shown).

Figure 7A:
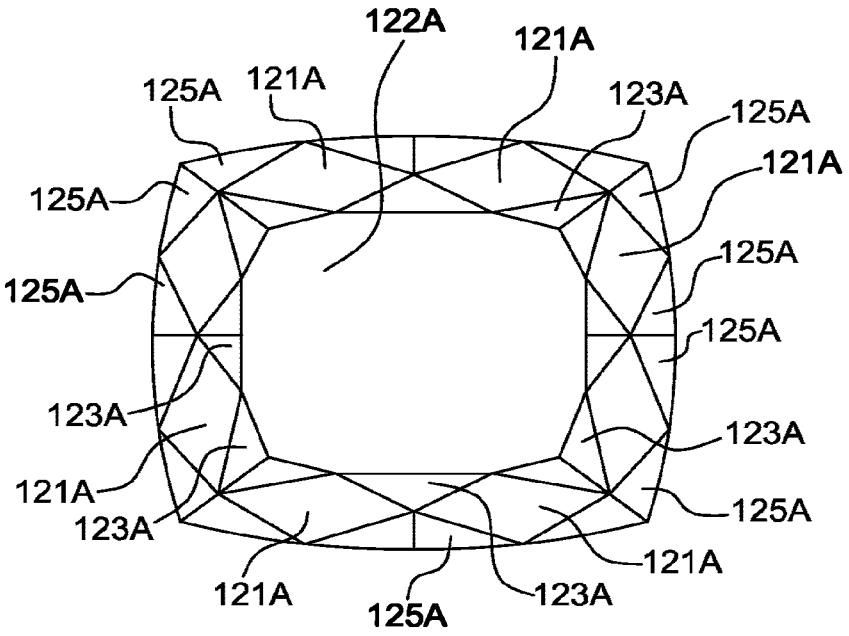
FIG. 7A is a top plan view of an alternate crown facet arrangement for a cushion shaped, shallow pavilion diamond in accordance with a second embodiment of the invention.

FIG. 7A illustrates an alternate crown facet arrangement for a cushion shaped, shallow pavilion diamond of the invention. The alternate crown 124A includes table facet 122A, eight bezel facets 121A, fourteen star facet 123A, and sixteen upper girdle facets 125A. FIGS. 7C and 7D similarly illustrate additional alternate crown facet arrangement for shallow pavilion, cushion cut diamonds of the invention. Crowns 124C, 124D each have a single table facet 122C, 122D; four bezel facets 121C, 121D; eight star facets 123C, 123D; and eight upper girdle facets 125C, 125D, respectively. The crown angle, crown height, girdle height for the alternate crowns 124A, 124C, 124D are within the parameters set for in Table 2.

Figure 7B:
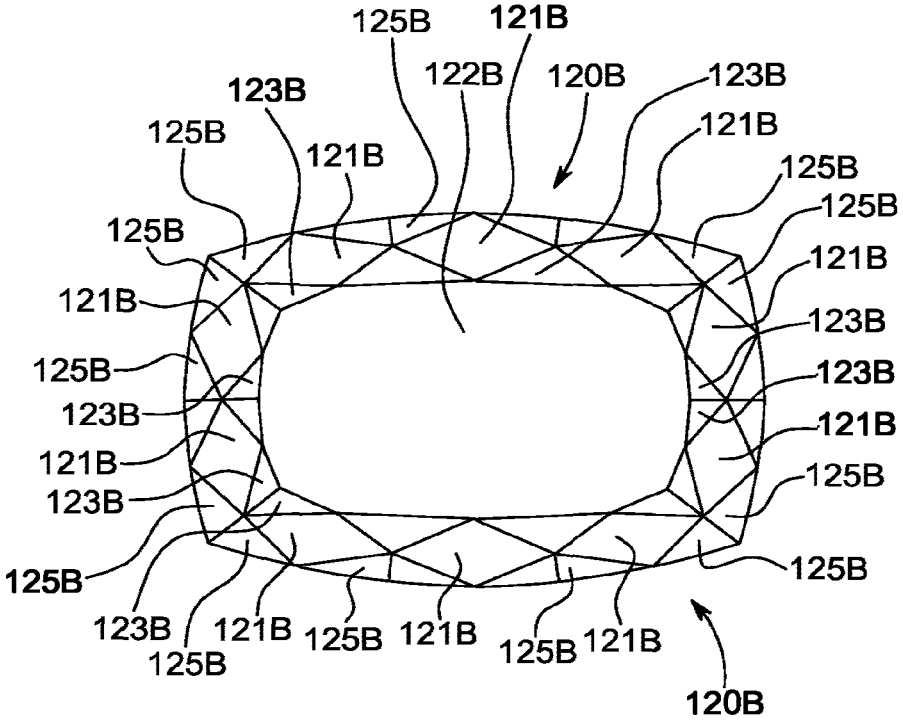
FIG. 7B is a top plan view of a second cushion shaped, shallow pavilion diamond in accordance with a second embodiment of the invention.
Figure 7C:
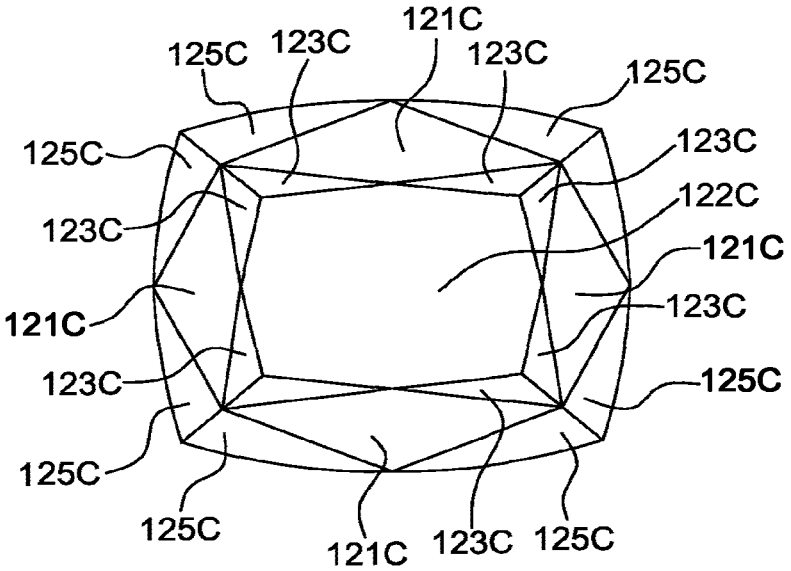
FIG. 7C is a top plan view of an alternate crown facet arrangement for a cushion shaped, shallow pavilion diamond in accordance with a second embodiment of the invention.
Figure 7D:
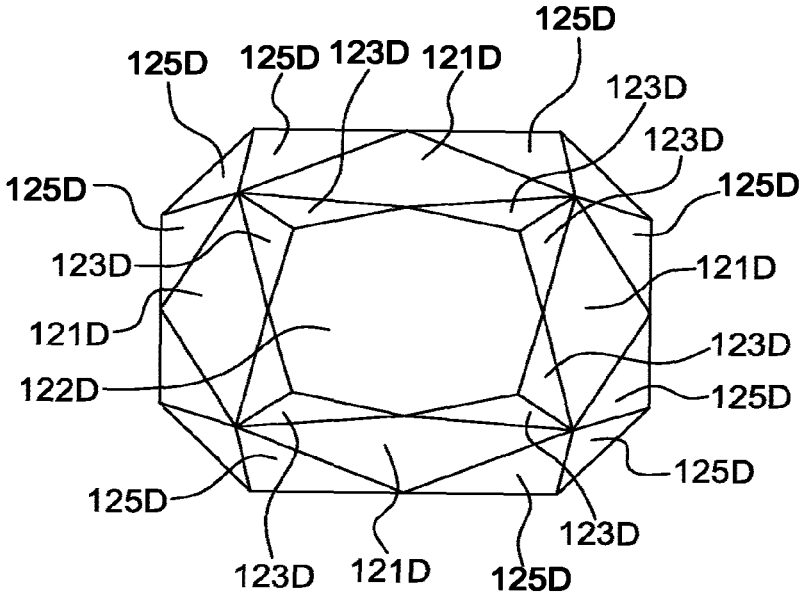
FIG. 7D is a top plan view of an alternate crown facet arrangement for a cushion shaped, shallow pavilion diamond in accordance with a second embodiment of the invention.
Figure 8B:
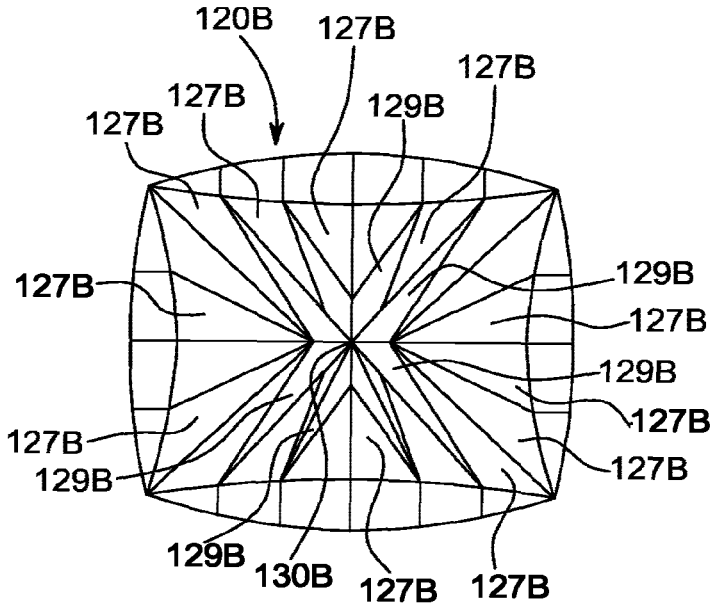
FIG. 8B is a bottom plan view of the cushion shaped, shallow pavilion diamond of the invention in accordance with the embodiment of FIG. 7B.

FIGS. 7B and 8B illustrate a more elongated shallow pavilion, cushion cut diamond 120B in accordance with the invention. The shallow pavilion, cushion cut diamond 120B has a crown 124B having a single table facet 122B, ten bezel facets 121B, sixteen star facets 123B, and twenty upper girdle facets 125B. The pavilion 126B comprises a total of twenty-nine facets including twenty lower girdle facets 127B, eight main pavilion facets 129B, and a pointed culet 130B. The crown angle, crown height, girdle height, pavilion angle, table percentage, and total depth percentage for the shallow pavilion, cushion cut diamonds 120 and 120B are all within the parameters set for in Table 2 above.

The present inventor has discovered that a brilliant-like reflection pattern can be obtained by providing a cushion shaped, cut diamond and other fancy cut diamond shapes with a shallow pavilion angle combined with a pointed culet at the bottom of the pavilion. The pavilion angles for the fancy cut diamonds of the invention range between twenty five to thirty four and one half degrees, preferably between thirty to thirty two degrees. By utilizing the combination of a pointed culet and shallow pavilion angle in accordance with the fancy cut diamonds of the invention realizes improved brilliance and light amplification characteristics relative to traditional steep pavilion angle fancy cut diamonds of the prior art. The maximum and minimum crown angles for the shallow pavilion, fancy cut diamonds of the invention are between about twenty nine degrees and about thirty four and one half degrees. The crown angle for the shallow pavilion, fancy cut diamonds of the invention are preferably in the range of from thirty and thirty five degrees.

By adhering to the criteria set forth in the Table 2, the light pattern for shallow pavilion, fancy cut diamonds 120, 120B, 220, 220A, 320 and 420 of the invention, follows a path whereby light is reflected from one pavilion surface to an opposed crown surface, then to another pavilion surface, then to the table, then back to a pavilion surface, then to the crown, then to an opposed pavilion surface and only then out to the table in a manner similar to that shown above in FIG. 6 for the round, shallow pavilion diamond 20 of the invention. This light pattern with light rays being repeatedly reflected and refracted between many internal diamond surfaces of the shallow pavilion diamond of the invention creates an extremely brilliant light display when compared to traditional deep pavilion, fancy diamonds. As a result of the repeated reflection and refraction, the light transmitted from the table of the shallow pavilion, fancy cut diamonds 120, 120B, 220, 220A, 320, and 420 is quite brilliant and is visually similar to that measured for the round, shallow pavilion diamond 20 of the invention discussed above and illustrated in FIG. 6.

Figure 10:
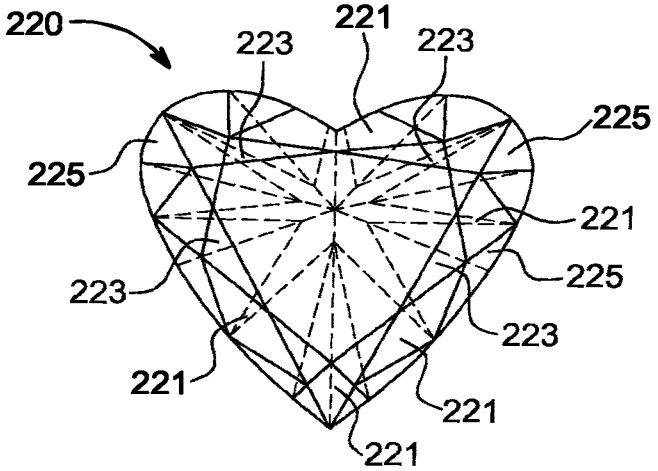
FIG. 10 is a top plan view of heart shaped, shallow pavilion diamond in accordance with a third embodiment of the invention with the pavilion facets shown with phantom lines.
Figure 11:
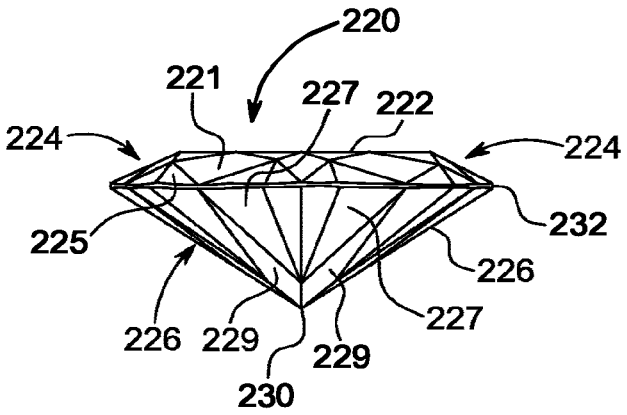
FIG. 11 is a side plan view of the short side of the heart shaped, shallow pavilion diamond of the invention in accordance with the embodiment of FIG. 10.
Figure 12:
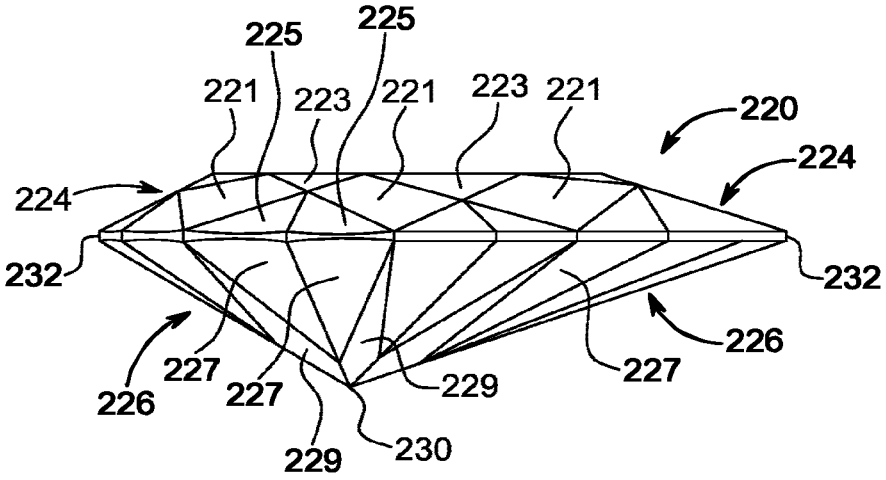
FIG. 12 is an enlarged, side plan view of the long side of the heart shaped, shallow pavilion diamond of the invention in accordance with the embodiment of FIG. 10.
Figure 13:
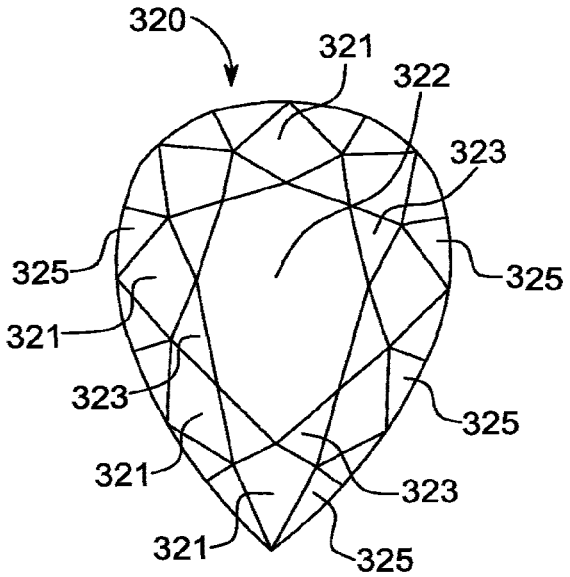
FIG. 13 is a top plan view of a pear shaped, shallow pavilion diamond in accordance with a fourth embodiment of the invention.

FIGS. 10-12 illustrate a heart shaped, shallow pavilion diamond 220 in accordance with the invention. The heart shaped, shallow pavilion diamond 220 has a table 222, a crown 224 extending downwardly from the table 222, a girdle 232 located below the crown 224, and a pavilion 226 extending downwardly from the girdle 232. The pavilion 226 surface narrows in width to a pointed culet 230. FIG. 12 shows that the pavilion 226 extends at a shallow pavilion angle within the range set forth in Table 2 relative to the plane of the table (or to a line parallel to the table passing through the girdle) of the diamond. Similarly, the crown angle is also within the ranges listed in Table 2. The crown 224 and pavilion 226 portions of the heart shaped, shallow pavilion diamond 220 are separated by a narrow girdle portion 232. The girdle 232 best seen in FIG. 12 is a smooth polished heart shaped band, but may also be multi-faceted with tiny facets approximating a heart shaped band (not shown).

The heart shaped, shallow pavilion diamond 220 of the invention is comprised of a total of 56 facets. The crown 224 has 32 facets including a single table facet 222, eight bezel facets 221, eight star facets 223, and fifteen upper girdle facets 225. The pavilion 226 comprises a total of twenty four facets including sixteen lower girdle facets 227, seven main pavilion facets 229, and a single pointed culet 230 as best seen in FIGS. 10 and 12. The crown angle is measured between the surface of each of the bezel facets 221 and the plane of the table 222 (average of each measured angle for the bezel facets). The pavilion angle is measured between the plane of the table 222 and main pavilion facets 229. The pointed culet 230 may be a less than sharp such as shown with slightly pointed beveled culet 230 shown in FIGS. 11-12. Alternately, the pavilion 226 may narrow to a pointed culet that is a "true point," that is, a very sharp point (not shown).

Figure 10A:
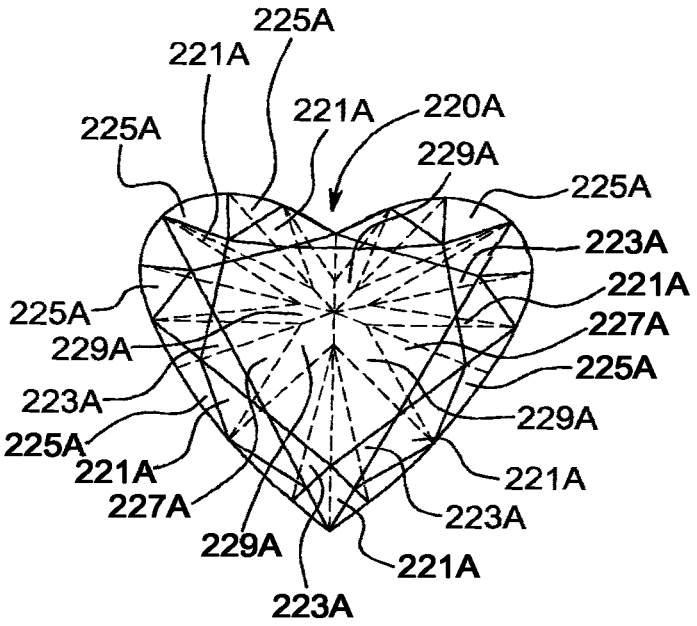
FIG. 10A is a top plan view of second heart shaped, shallow pavilion diamond in accordance with a third embodiment of the invention with an alternate arrangement of crown facets and an alternate arrangement of pavilion facets shown with phantom lines.

FIG. 10A illustrates an alternate facet configuration for a shallow pavilion, heart shaped diamond 220A in accordance with the invention. The shallow pavilion, heart shaped diamond 220A has a total of 52 facets. The crown 224A has 35 facets including a single table facet 222A, nine bezel facets 221A, nine star facets 223A, and sixteen upper girdle facets 225A. The pavilion 226A comprises a total of twenty-seven facets, including eighteen lower girdle facets 227A, eight main pavilion facets 229A, and a single pointed culet 230A. The shallow pavilion, heart shaped diamond of FIGS. 10 and 10A have crown angles, crown heights, girdle heights, pavilion angles, table width percentage, and total depth percentage within the parameters set forth in Table 2.

Figure 14:
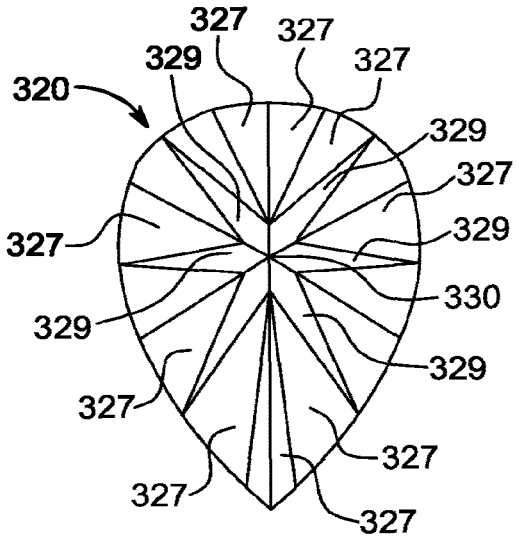
FIG. 14 is a bottom plan view of a pear shaped, shallow pavilion diamond in accordance with the embodiment of FIG. 13.
Figure 15:
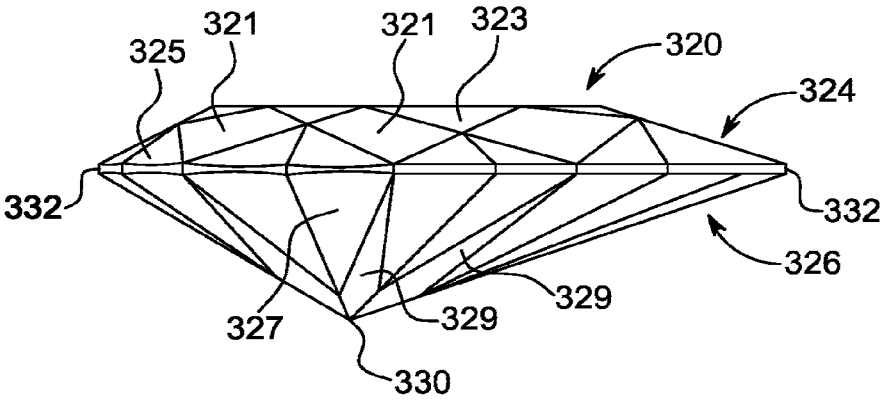
FIG. 15 is an enlarged, side plan view of the long side of the pear shaped, shallow pavilion diamond of the invention in accordance with the embodiment of FIG. 13.
Figure 16:
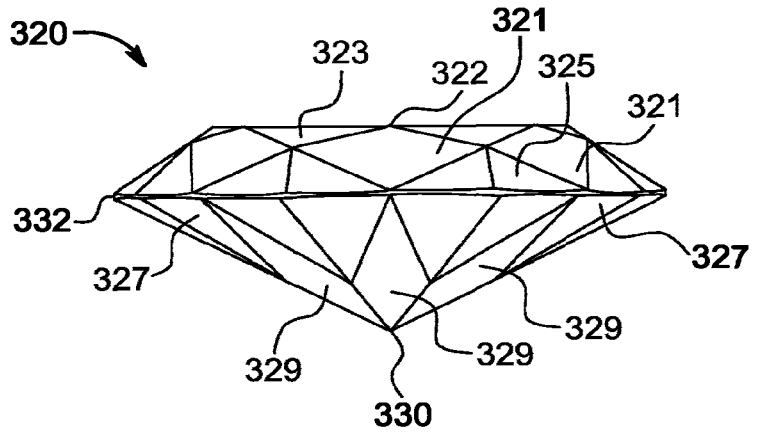
FIG. 16 is a side plan view of the short side of the pear shaped, shallow pavilion diamond of the invention in accordance with the embodiment of FIG. 13.
Figure 17:
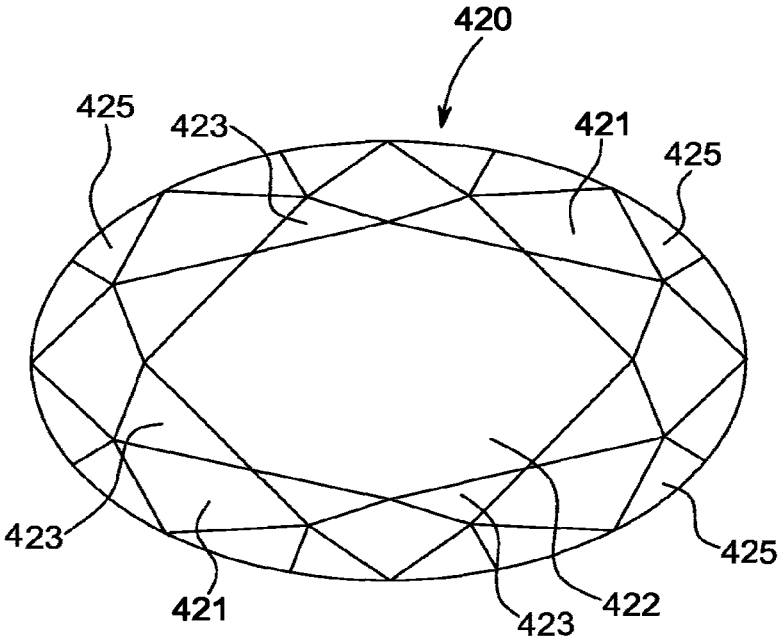
FIG. 17 is an enlarged, top plan view of an oval shaped, shallow pavilion diamonds in accordance with a fifth embodiment of the invention.

FIGS. 13-16 illustrate a pear shaped, shallow pavilion diamond 320 of the invention. The pear shaped cut diamond 320 has a table 322, a crown 324 extending downwardly from the table 322, a girdle 332 located below the crown 324, and a pavilion 326 extending downwardly from the girdle 332. The pavilion 326 surface narrows in width to a pointed culet 330. FIGS. 15-16 show that the pavilion 326 extends at a shallow pavilion angle within the parameters set forth in Table 2 relative to the plane of the table (or to a line parallel to the table passing through the girdle) of the diamond. Similarly, the crown angle is within the parameters set forth in Table 2 above. The crown 324 and pavilion 326 portions of the cushion, cut diamond 320 are separated by a narrow girdle portion 332. The girdle 332 best seen in FIG. 15-16 is a smooth polished pear shaped band, but may also be multi-faceted with tiny facets approximating a pear shaped band (not shown).

Figure 14A:
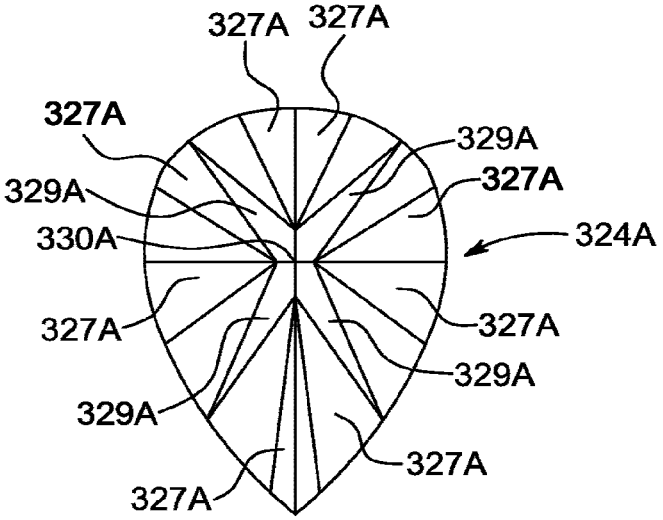
FIG. 14A is a top plan view of a pear shaped, shallow pavilion diamond illustrating an alternate arrangement of pavilion facets for a diamond in accordance with the third embodiment of the invention

The pear shaped, shallow pavilion diamond 320 of the invention is comprised of a total of 56 facets. The crown 324 has 33 facets including a single table facet 322, eight bezel facets 321, eight star facets 323, and sixteen upper girdle facets 325. The pavilion 326 comprises a total of 23 facets including sixteen lower girdle facets 327, six main pavilion facets 329, and a single pointed culet 330 as best seen in FIGS. 14-16. The crown angle is measured between the surface of each of the bezel facets 321 and the plane of the table 322 (average of each measured angle for the bezel facets). The pavilion angle is measured between the plane of the table 322 and main pavilion facets 329. The pointed culet 330 may be a less than sharp such as shown with pointed culet 330 shown in FIGS. 13-16. Alternately, the pavilion 326 may narrow to a more sharply pointed culet (not shown). FIG. 14A illustrates an alternate pavilion facet arrangement for use in a pear shaped, shallow pavilion diamond of the invention. The alternate pavilion 326A comprises a total of 21 facets including sixteen upper girdle facets 327A, four main pavilion facets 329A and one pointed culet 330A. The crown angle, crown height, girdle height, pavilion angle, table percentage, and total depth percentage of the pear shaped, shallow pavilion diamond 320 and the pavilion angle, table width percentage, and total depth percentage for the alternate pavilion 326A all fall within the parameters set forth in Table 2.

Figure 18:
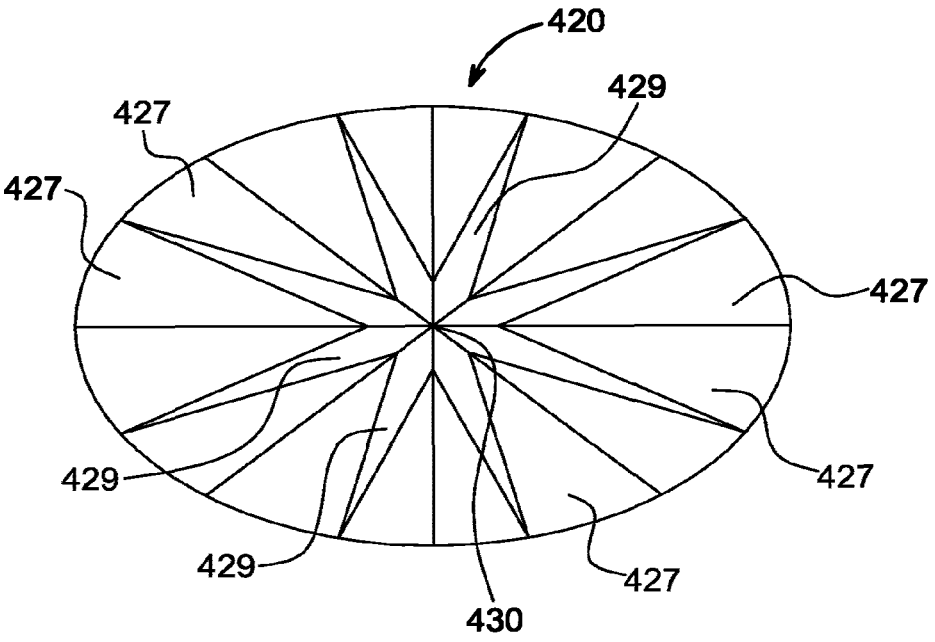
FIG. 18 is an enlarged, top plan view of an oval shaped, shallow pavilion diamond with the pavilion facets shown in phantom lines in accordance with the embodiment of FIG. 17.
Figure 19:
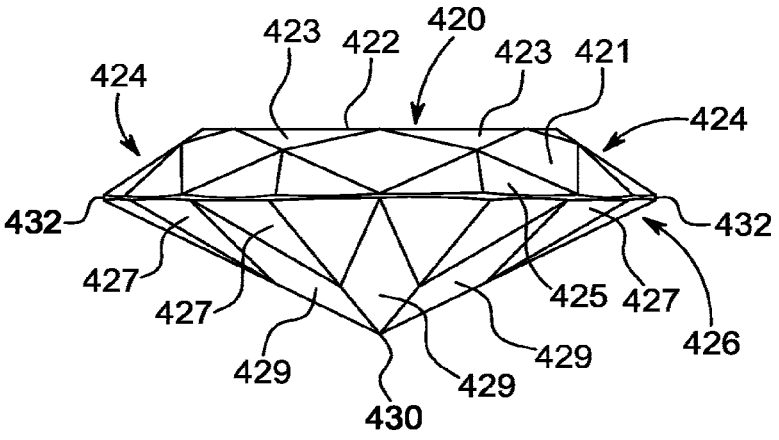
FIG. 19 is a side plan view of the long side of the oval shaped, shallow pavilion diamond of the invention in accordance with the embodiment of FIG. 17.
Figure 20:
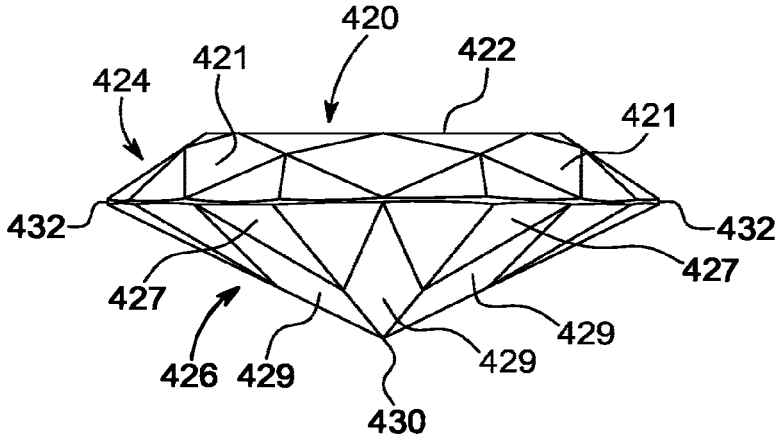
FIG. 20 is a side plan view of the short side of the oval shaped, shallow pavilion diamond of the invention in accordance with the embodiment of FIG. 17.

FIGS. 17-20 illustrate an oval shaped, shallow pavilion diamond 420 of the invention. The oval shaped cut diamond 420 has a table 422, a crown 424 extending downwardly from the table 422, a girdle 432 located below the crown 424, and a pavilion 426 extending downwardly from the girdle 432. The pavilion 426 surface narrows in width to a pointed culet 330. FIGS. 19-20 show that the pavilion 426 extends at a shallow pavilion angle within the parameters set forth in Table 2 relative to the plane of the table (or to a line parallel to the table passing through the girdle) of the diamond. Similarly, the crown angle is within the parameters set forth in Table 2 above. The crown 424 and pavilion 426 portions of the oval shaped, shallow pavilion diamond 420 are separated by a narrow girdle portion 432. The girdle 432 best seen in FIGS. 19-20 is a smooth polished oval shaped band, but may also be multi-faceted with tiny facets approximating an oval shaped band (not shown). The crown angle, crown height, girdle height, pavilion angle, table width percentage, and total depth percentage of the oval shaped, shallow pavilion diamond 420 fall within the parameters set forth in Table 2.

The oval shaped, shallow pavilion diamond 420 of the invention is comprised of a total of 58 facets. The crown 424 has a total of 33 facets including a single table facet 422, eight bezel facets 421, eight star facets 423, and sixteen upper girdle facets 425. The pavilion 426 comprises a total of twenty-five facets including sixteen lower girdle facets 427, eight main pavilion facets 429, and a single pointed culet 430 as best seen in FIGS. 18-20. The crown angle is measured between the surface of each of the bezel facets 421 and the plane of the table 422 (average of each measured angle for the bezel facets). The pavilion angle is measured between the plane of the table 422 and main pavilion facets 429. The pointed culet 430 may be a less than sharp such as shown with pointed culet 430 shown in FIGS. 19-20. Alternately, the pavilion 426 may narrow to a more sharply pointed culet (not shown). The crown angle, crown height, girdle height, pavilion angle, table width percentage, and total depth percentage of the oval shaped, shallow pavilion diamond 420 fall within the parameters set forth in Table 2.

Although the present invention has been described in relation to particular embodiments thereof, many other variations and modifications and other uses will become apparent to those skilled in the art. It is preferred, therefore, that the present invention be limited not by the specific embodiments disclosed herein, but only by the appended claims.

The invention claimed is:

1. A round cut diamond comprising:

a crown including a table and several crown facets, some of said crown facets extending downwardly from said table at a crown angle in a range of 33-35°;

a girdle, the girdle being below the crown; and a pavilion including several pavilion facets, the pavilion extending downwardly from the girdle at a pavilion angle in a range of 30-33° to a single-pointed culet, wherein the round cut diamond is configured so ambient light enters the table and follows a path including reflection from at least four interior diamond surfaces before the reflected light exits through the table.

2. The round-cut diamond of claim 1 wherein the crown facets include eight bezel facets, eight star facets and sixteen upper girdle facets.

3. The round-cut diamond of claim 1 wherein the pavilion facets include sixteen lower girdle facets and eight main pavilion facets.

4. The round-cut diamond of claim 1 wherein the girdle is polished with small facets.

5. The round-cut diamond of claim 1 wherein the light passes through the table to one of the twenty-four facets of the pavilion, the light is then reflected from the one of the twenty-four facets of the pavilion to the table facet, the light are is then reflected from the table facet to the girdle, the light is then reflected from the girdle to one of the twenty-four facets of the pavilion, and the light is then reflected from the one of the twenty-four facets of the pavilion out to the table.

6. The round cut diamond of claim 1, which produces 69% of the entering light transmitted through the table.

7. The round cut diamond of claim 2, which produces 69% of the entering light transmitted through the table.

8. The round cut diamond of claim 3, which produces 69% of the entering light transmitted through the table.

9. The round cut diamond of claim 4, which produces 69% of the entering light transmitted through the table.

10. The round cut diamond of claim 5, which produces 69% of the entering light transmitted through the table.

11. The round cut diamond of claim 1 wherein the diamond has a crown height of 7-15%.

12. The round cut diamond of claim 1 wherein the diamond has a crown height of 9-12%.

13. The round cut diamond of claim 1 wherein the diamond has a girdle height of 1.5-5%.

14. The round cut diamond of claim 1 wherein the diamond has an overall depth of less than about 3 mm.

15. The round cut diamond of claim 5 wherein the diamond has an overall depth of less than about 3 mm.

16. The round cut diamond of claim 12 wherein the diamond has an overall depth of less than about 3 mm.

17. The round cut diamond of claim 13 wherein the diamond has an overall depth of less than about 3 mm.

18. A round cut diamond comprising:

a crown including a table and several crown facets, some of said crown extending downwardly from said table at a crown angle in a range of 33-35°, a girdle, the girdle being below the crown; and a pavilion, the pavilion having several pavilion facets and extending downwardly from the girdle at a pavilion angle in a range of 30-33° to a single-pointed culet, the pavilion facets having substantially polished planar surfaces;

wherein the round cut diamond is configured so ambient light enters the table and follows a path including reflection from at least four interior diamond surfaces before the reflected light exits through the table.

19. The round-cut diamond of claim 18 wherein the light pass passes through the table to one of twenty-four facets of the pavilion, the light is then reflected from the one of the twenty-four facets of the pavilion to the table facet, the light is then reflected from the table facet to the girdle, the light is then reflected from the girdle to one of the twenty-four facets of the pavilion, and the light is then reflected from the one of the twenty-four facets of the pavilion out to the table.

20. The round cut diamond of claim 18, which produces 69% entering light transmitted through the table.

21. The round cut diamond of claim 18 wherein the diamond has a crown height of 7-15%.

22. The round cut diamond of claim 18 wherein the diamond has a crown height of 9-12%.

23. The round cut diamond of claim 18 wherein the diamond has a girdle height of 1.5-5%.

24. The round cut diamond of claim 18 wherein the diamond has an overall depth of less than about 3 mm.

* * * * *